US006709131B1

(12) United States Patent
Herst et al.

(10) Patent No.: US 6,709,131 B1
(45) Date of Patent: Mar. 23, 2004

(54) LUMINAIRE HAVING A MOCK LIGHT SOURCE FOR IMPROVED SOURCE BRIGHTNESS CONTROL AND METHOD

(75) Inventors: Douglas J. Herst, Ross, CA (US); Peter Y. Y. Ngai, Alamo, CA (US); Hue Ly, Richmond, CA (US)

(73) Assignee: Acuity Brands, Inc., Atlanta, GA (US)

( * ) Notice: Subject to any disclaimer, the term of this patent is extended or adjusted under 35 U.S.C. 154(b) by 0 days.

(21) Appl. No.: 09/641,469

(22) Filed: Aug. 17, 2000

Related U.S. Application Data

(60) Provisional application No. 60/149,807, filed on Aug. 18, 1999.

(51) Int. Cl.[7] ..... F21S 8/04

(52) U.S. Cl. ..... 362/223; 362/260; 362/290

(58) Field of Search ..... 362/217, 222, 362/223, 224, 260, 290, 291, 292, 432

(56) References Cited

U.S. PATENT DOCUMENTS

| | | | | |
|---|---|---|---|---|
| 4,573,111 A | * | 2/1986 | Herst et al. | 362/223 |
| 5,530,628 A | | 6/1996 | Ngai | |
| 5,716,123 A | | 2/1998 | Lamming | |
| 5,746,502 A | | 5/1998 | Huang | |
| 5,988,829 A | | 11/1999 | Holder | |
| 6,231,209 B1 | * | 5/2001 | Leibig et al. | 362/260 |

OTHER PUBLICATIONS

Peerless Lighting Product Brochure, 2 3/4" & 4" Rectangular Systems, 1993.

Peerless Lighting Catalog Sheet, 6"×6" Rectangular Lavatory Light, 1993.

Peerless Lighting Catalog Sheet, 6"×6" Rectangular, Library Stack Light, 1993.

Peerless Lighting Catalog Sheet, 9" Round, Open Up/Wide Spread Down, 1993.

Peerless Lighting Catalog Sheet, 3 1/2"×5 1/2" Rounded, Pendant Mount, 1993.

* cited by examiner

*Primary Examiner*—Y My Quach Lee
(74) *Attorney, Agent, or Firm*—Donald L. Beeson

(57) ABSTRACT

A luminaire has a brightness reduction cover element below and in proximity to the active light source of the luminaire to simulate a larger light source having a lower surface brightness which is exposed through the luminaire's down light opening. For example, where the luminaire has a high output T5 lamp, the brightness reduction cover element can be in the form of a substantially semi-cylindrical opal diffuser cover strip sized to simulate a T8 or T12 lamp. An opal diffuser cover strip having two side-by-side arcuate portions joined at opaque interior edges can be positioned under two side-by-side T5 lamps to simulate side-by-side T8 or T12 lamps. For a direct-indirect luminaires the brightness characteristics of the exposed light source is governed by the lower brightness mock light source, while the uplight distribution of the luminaire is produced from the higher intensity light emitted from the top surface portions of the T5 lamp (or other active light source) for maximum control over the indirect lighting component of the luminaire.

44 Claims, 5 Drawing Sheets

LUMINAIRE HAVING A MOCK LIGHT SOURCE FOR IMPROVED SOURCE BRIGHTNESS CONTROL AND METHOD

CROSS-REFERENCE TO RELATED APPLICATIONS

Applicants claim the benefit of U.S. Provisional Application No. 60/149,807, filed Aug. 18, 1999.

BACKGROUND OF THE INVENTION

The present invention generally relates to luminaires of the type most often used in architectural spaces, and more particularly to luminaires having a downlight component and an exposed light source having exposed high brightness surfaces that can produce visual discomfort and glare. The invention has particular application in luminaires having small dimensioned high-intensity lamps, such as a high-output T5 fluorescent lamp.

A wide range of luminaires have been designed to meet a variety of architectural lighting applications, including luminaires that provide direct lighting, indirect lighting, and a combination of both indirect and direct lighting. In the case of direct luminaires and luminaires for direct/indirect lighting, the source of illumination is either exposed in its entirety through the bottom of the luminaire or shielded by shielding elements such as parabolic baffles or lenses that cover the bottom opening of the luminaire. The choice of luminaire will depend on the objectives of the lighting designer for a particular application and the economic resources available. To meet his or her design objectives, the lighting designer, when choosing a luminaire, will normally consider a variety of factors including aesthetic appearance, desired light distribution characteristics, and sources of brightness that can detract from visual comfort.

Another important factor in selecting luminaires for a particular application is the choice of a light source. In this regard, the fluorescent lamp has long provided an economical and energy efficient alternative to incandescent lighting and has been the light source of choice among lighting designers in many commercial applications, particularly for indoor office lighting. For many years the most common fluorescent tube sizes for use in indoor lighting have been the T8 (1 inch diameter) and T12 (1½ inch diameter) lamps. More recently, however, smaller dimensioned, high-output fluorescent lamps have become available which provide a high lumen output from a comparatively small lamp envelope. An example is the high output T5 (⅝ inch diameter) lamp manufactured by Osram/Sylvania and other manufacturers. This fluorescent lamp has a number of advantages over its larger predecessors, the T8 and T12, including the ability to design luminaires which produce a high lumen output with fewer lamps reducing lamp disposal requirements and even potentially lamping costs as the cost of high output T5 lamps comes down. The smaller diameter T5 lamps also permit smaller luminaires to be designed. They further allow the designer to achieve greater control over light distribution because of the small light emitting surface areas involved. As a consequence, wider light distribution patterns can be achieved permitting greater spacing between luminaires without sacrificing coverage and lighting uniformity.

High-output compact fluorescent lamps, however, have a significant drawback: the lamp surfaces are extremely bright as compared to larger diameter lamps. For example, a high-output T5 lamp will have a surface brightness in the range of 8,000 footlamberts (FL), whereas the brightness of the larger T8 and T12 lamps will be in the range of 3,000 FL and 2,000 FL, respectively. The consequence of such bright surfaces is quite severe in downlight applications where the lamps may be exposed within direct viewing angles. Without adequate shielding, fixtures employing such lamps will be very uncomfortable to look at directly, and will produce direct and reflected glare that impairs the comfort of the lighting environment. Heretofore, shielding has been devised to cover or substantially surround a fluorescent lamp to mitigate surface brightness problems; however, such shielding defeats the advantages of a compact fluorescent lamp in regions of distribution where the lamp's surfaces are not directly viewed or do not set up reflected glare patterns. Thus, with conventional shielding designs, the distribution efficiencies and high lumen output advantages of the compact lamp can be substantially lost. Another known approach to solving the problem of direct glare associated with the use of high intensity fluorescent lamps in downlight applications has resulted from the use of biax lamps in direct-indirect luminaires. This approach has been to use the biax lamps only for the uplight component of the luminaire while using T-8 lamps with their lower brightness surfaces for the luminaire's down-light component. However, such design approaches have the drawback that the extra lamps impair they designers ability to achieve a desired light distribution from a given physical envelope and impose added burdens on lamp maintenance programs which must stock and handle two different types of lamps.

The present invention overcomes the above-described disadvantages of high-output light sources by providing a mock light source in the downlight opening of a luminaire which, from the point of view of the downlight opening, behaves like a larger lamp size having a larger, lower brightness surface area, but which otherwise permits the luminaire to take advantage of the distribution and output efficiencies of the small dimensioned high-output lamp. For example, a luminaire having a mock light source in accordance with the invention permits a direct-indirect luminaire to be designed using one or more high output T5 fluorescent lamps where the luminaire's uplight distribution is advantageously produced directly from the lamp's extremely bright, relatively small surfaces, while the downlight component of the luminaire is produced principally from a mock lamp that behaves and looks like a T8 or T12 lamp having surface brightness characteristics that are three to four times less than the T5 lamp. Because the downlight opening sees a mock lamp having more conventional lamp dimensions with more conventional lamp brightness characteristics, conventional downlight shielding can be used without having to design special optics to account for the special characteristics of an extremely bright high intensity source. At the same time the problem of distracting direct glare associated with high intensity sources being used in the downlight opening of a direct or direct-indirect luminaire is reduced. This is accomplished without the addition of lamps and the added costs associated therewith.

SUMMARY OF THE INVENTION

In summarizing and describing the invention, reference will be made to an "active" light source as distinct from a "mock" or "passive" light source which is intended to simulate an active light source. The "active" light source shall be understood to mean the energized lamp or lamps which generate the actual lumen output of the luminaire.

Briefly, the invention involves a luminaire which comprises a housing having a downlight opening, an active light source operatively held in the housing above the downlight opening, and a brightness reduction cover element operatively positioned in the housing below and in proximity to the bottom surface portion of the light source so as to intercept light emitted therefrom. The brightness reduction cover element is sized and shaped to cover the bottom surface portion of the light source to substantially the minimum extent necessary to prevent line-of-sight exposure of the active light source through the housing's bottom opening and to the extent necessary to provide an observable source of reduced brightness just below the active light source which simulates a lower brightness source of light. Other surface portions of the light source not covered by the brightness reduction cover element remain available to contribute directly to the overall lumen output of the luminaire. The brightness reduction cover element can be positioned directly above, and at least in part supported by a baffle structure which shields the cover element from direct view at high viewing angles and which controls the distribution of light passing through the housing's downlight opening.

In one embodiment of the invention, the brightness reduction cover element is provided in the form of a light diffuser cover strip that provides a uniformly bright surface and that has an elongated arcuate shape to simulate the surface of a larger diameter fluorescent tube. Alternatively, the brightness reduction element could be fabricated of a perforated sheet metal material having small openings which provide an average reduced brightness to the observer. To reduce spot brightness at its perforation openings, a diffuser liner can, if desired, be affixed to at least one surface of the perforated sheet material.

The following are specific examples of a brightness reduction element for use in a luminaire having a T5 high-output active light source: an elongated arcuate-shaped opal diffuser cover strip having a radius of approximately ¾ inch to simulate a 1½ inch diameter T12 fluorescent lamp, and a similarly shaped diffuser cover element having a radius of approximately ½ inch to simulate a 1 inch diameter T8 fluorescent lamp. Other shapes and sizes can also be chosen to meet the particular needs of the lighting designer, including a trough-shaped or triangular-shaped diffuser cover element to simulate the appearance of a fluorescent lamp that has a square or triangular shape. The composition of the opal diffuser material used to fabricate the cover strip can be chosen to simulate a desired whiteness.

In a further aspect of the invention, the luminaire is provided in the form of a direct/indirect luminaire having a housing with both uplight and downlight openings. The brightness reduction cover element, which again is positioned below and in proximity to the bottom surface portion of the active light source, permits an observable source of reduced brightness to be exposed through the housing's downlight opening while permitting the uplight portion of the luminaire to be governed by the high lumen output from the top surface portion of the smaller active light source. While the invention has particular applicability in this luminaire type, it could also be used in a purely direct luminaire where the high lumen output from the top surface portion of the active light source is redirected by internal optical components of the luminaire through the downlight opening of the luminaire housing.

In still another aspect of the invention, the brightness reduction cover element is replaceably held in its operative position within the luminaire such that cover elements can readily be exchanged to permit modification of the luminaire's brightness and/or color characteristics to meet particular lighting design and application needs.

The invention also involves a method of producing direct and indirect lighting from an active high output light source, such as a T5 lamp, having top and bottom surface portions with relatively high surface brightness. The method comprises the steps of producing uplight for indirect lighting directly from the top surface portion of the light source, and producing downlight for direct lighting through a brightness reduction cover element positioned below and in close proximity to the light source's bottom surface. The brightness reduction cover element is sized and shaped to surround the bottom surface portion of the light source so as to simulate a relatively low brightness light source having a larger surface area than the surface area of the active high output source.

It is therefore a primary object of the invention to provide a direct or direct-indirect luminaire having a mock light source for improved source brightness control. It is a further object of the invention to provide a luminaire and method which can take advantage of compact, high-output light sources without introducing excessive brightness into an architectural space. It is a further object of the invention to provide a luminaire having a compact high-output light source wherein light emitted from the bottom surfaces of the light source is intercepted for source brightness control, while light emitted from the top surfaces of the light source is available for improved lumen output and light distribution from the luminaires It is still another object of the invention to provide a luminaire and method which can utilize compact, high-output light sources while at the same time permitting the use of conventional parabolic baffles or other conventional shielding designs in the downlight opening of the luminaire.

Other objects of the invention will be apparent from the following description and claims.

DETAILED DESCRIPTION OF THE ILLUSTRATED EMBODIMENT

Figure 1:
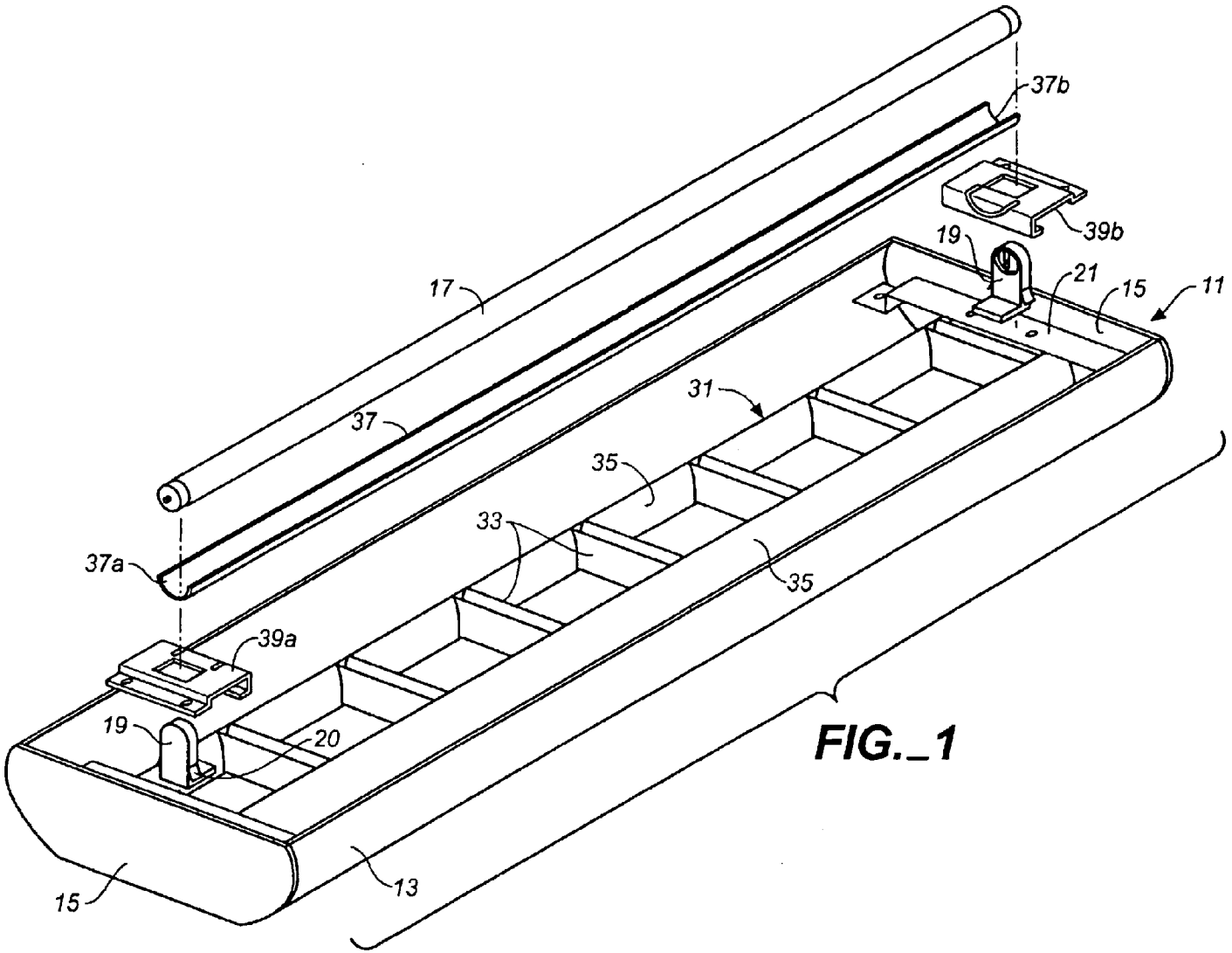
FIG. 1 is an exploded top perspective view of a direct-indirect luminaire in accordance with the invention.

Referring now to the drawings, FIGS. 1 through 4 show a direct-indirect luminaire 11 having an elongated, suitably extruded aluminum housing 13 terminated by end caps 15. The luminaire housing supports the internal components of the luminaire, which include a light source in the form of a compact high-output fluorescent lamp 17 held by lamp sockets 19 which in turn are mounted to socket straps 21 fastened by suitable screw fasteners 25 to screw channels 23 formed in the bottom of the housing. The fluorescent lamp 17 is sometimes referred to herein as the "active" light source in that, as above-mentioned, it generates the lumen output of the luminaire.

Figure 2:
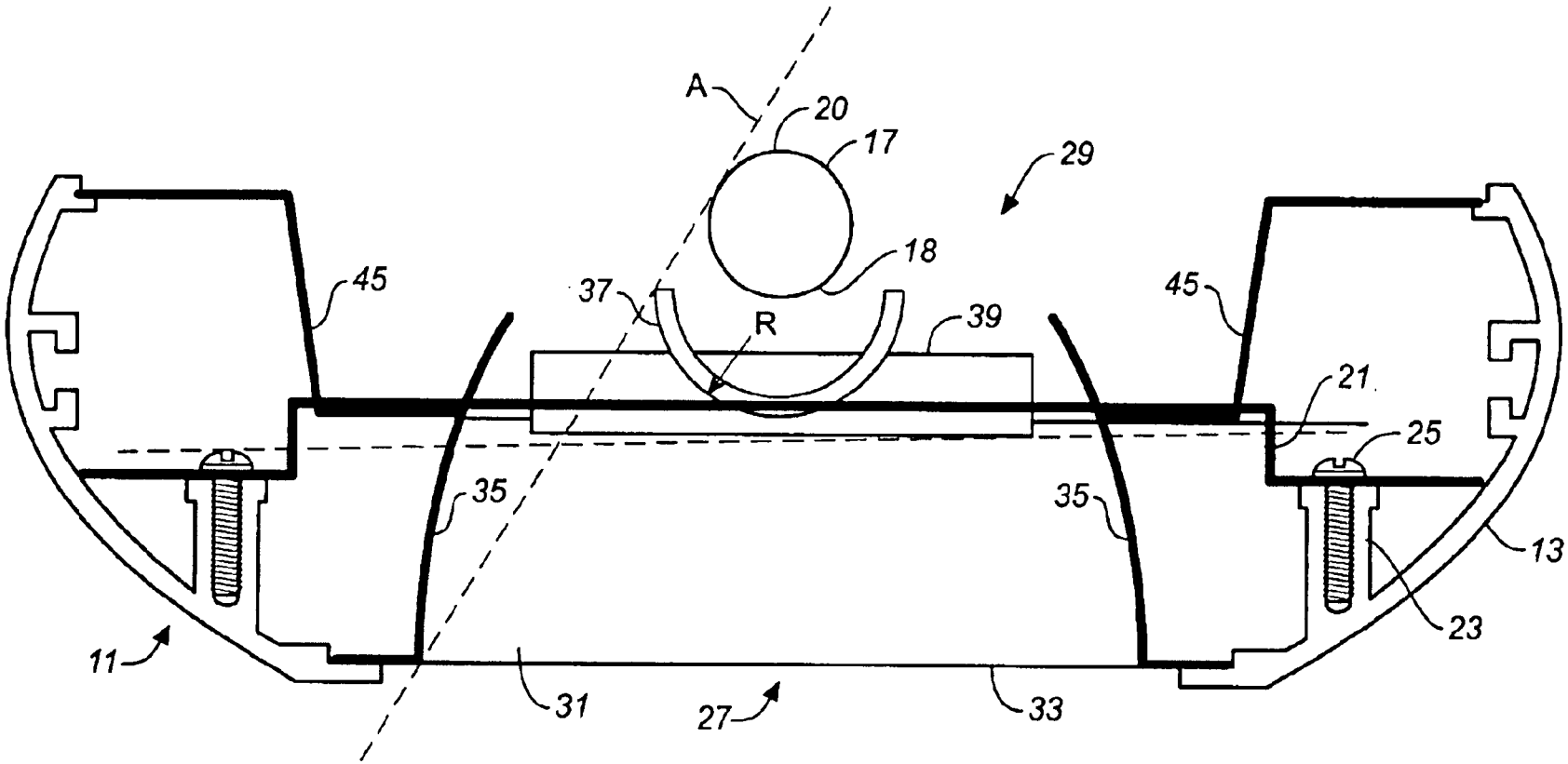
FIG. 2 is an end elevational view thereof shown in cross-section.
Figure 3:
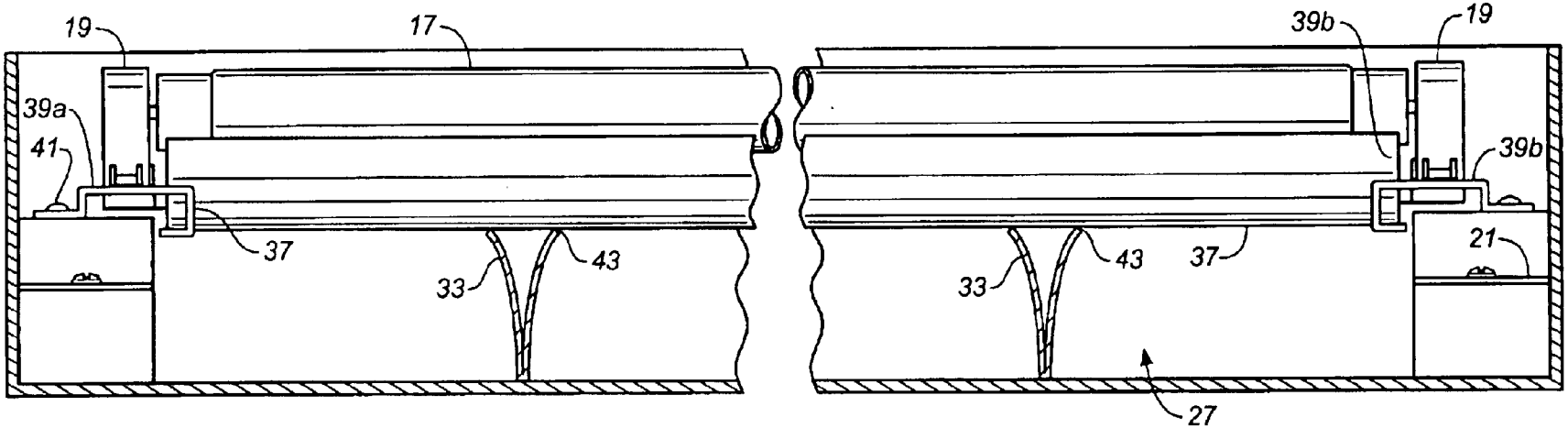
FIG. 3 is a side elevational view thereof shown in cross-section.

As best illustrated in FIGS. 1 and 2, the housing 13 of luminaire 11 has both a bottom downlight opening 27 and a top uplight opening 29 for producing, respectively, the downlight and uplight components of the luminaire's polar light distribution pattern. A conventional parabolic baffle structure 31 is placed in the downlight opening. This baffle structure has a cellular construction consisting of transverse, uniformly spaced parabolic baffle elements 33 connected between reflective side rails 35. The side rails and baffles all have curved "parabolic" specular reflective surfaces of a standard optical design to work with conventional lamp sizes, such as the T8 or T12 lamps. As hereinafter described, rather than seeing the active light source 17, the reflective surfaces of the baffle structure will see and provide shielding for a mock lamp having lower surface brightness than the active source; specifically, they will reflect the mock source light away from high viewing angles to prevent an image of the mock source and its associated brightness, albeit lower brightness, from being reflected back to the observer at normal viewing positions. Such shielding is necessary to meet brightness control standards in certain applications such as the ANSI RP-1 standard for direct lighting in VDT environments.

Specifically, as viewed through the downlight opening 27 and as seen-by the baffle structure, a mock light source is provided by a passive brightness reduction cover element in the form of an elongated arcuate diffuser cover strip 37 having ends 37*a* and 37*b*, which is operatively positioned in the housing below and in close proximity to lamp 17. The diffuser cover strip is replaceably held in its operative position below lamp 17 by opposed retainer brackets 39 secured to the center of the luminaire's socket straps 21 by suitable screw fasteners 41 (see FIG. 3). It can be seen that when the diffuser cover strip is operatively held in retaining brackets 39 at its ends 37*a* and 37*b* it is further supported along the top edges 43 of the transverse baffle elements of the luminaire's baffle structure 31.

Referring to FIG. 2, it can further be seen that the diffuser cover strip 37 extends upwardly (in a shape that approximates a semi-cylinder) about the bottom surface portion 18 of lamp 17 to a distance necessary to prevent exposure of high brightness surfaces of the lamp through the luminaire's bottom opening 27. The upward extension of the semi-cylindrical diffuser strip necessary to achieve this cutoff is represented by the cutoff angle "A" denoted by a dashed line in FIG. 2. The diffuser strip should not extend substantially beyond this cutoff and preferably will terminate at or just beyond the cutoff in order to permit maximum utilization of the high-lumen output from the lamp in the regions of the luminaire's light distribution which do not fall within direct sight lines.

By designing the diffuser strip 37 with a radius R that approximately corresponds to the diameter of a standard non-compact fluorescent tube, such as a T8 or T 12 lamp, and by designing it to exhibit a surface brightness characteristic of such standard lamp sizes, the luminaire, when viewed through the downlight opening at angles at which the diffuser strip is exposed, will appear to be a standard larger sized lamp. The brightness characteristics of the cover strip will generally be determined by careful selection of the diffuser material and its transmission characteristics. By experimenting with different materials, including taking brightness measurements on sample diffuser strips in mock up luminaires, desired brightness characteristics can be arrived at.

The diffuser cover strip 37 can suitably be fabricated of an extruded heat-resistant opal acrylic diffuser material, such as a V825 HID Autohass opal diffuser. The material of the diffuser strip should have good UV stability and must be able to withstand the high heat environments which occur in proximity to the lamps of the luminaire. While a semi-diffuse material could be used, the best mode of the invention would call for the use of a totally diffuse material, such as the above-mentioned opal diffuser material, to achieve optimum brightness control and brightness uniformity. In addition, the thickness and/or light transmissive characteristics of the diffuser cover strip can be selected to meet different design criteria, such as adjusting the proportion of downlight versus uplight emitted from the luminaire. Thus, it is possible to modify the light distribution pattern of the luminaire by simply exchanging cover strips. Color can also be added to the diffuser material as desired for achieving desired special visual effects.

The following is a suitable specification for an arcuate diffuser strip used below a high-output T5 lamp in the single lamp version of the luminaire illustrated in FIGS. 1–4 to simulate a white T8 lamp:

| | |
|---|---|
| Distance from bottom of diffuser cover strip to lamp center | ⅞ inch |
| Overall height of diffuser cover strip | ¾ inch |
| Radius R of diffuser strip | 19/32 inch |
| Thickness of diffuser strip | 1/16 inch |
| Diffuser material | translucent white acrylic consisting of 3 lbs #1401 white added to 100 lbs, V825 HID, UL-94 HB compliance |

It will be understood that the amount of white added can be varied to vary the transmission and color temperature of the mock lamp. It is contemplated that, in many if not most applications, the designer will want to adjust the white additive so that the color temperature of the passive mock lamp or lamps and the color temperature of the active lamp or lamps of the luminaire are substantially the same.

It is noted that a widespread distribution of light from the top opening 29 of the luminaire housing is in part achieved by bent side reflectors 45 mounted in the top portion of the housing. With a high lumen output compact T5 lamp, the spread of light from the top of the fixture can be substantially increased from a comparable spread of light from a larger lower-output T8 lamp. For example, the single lamp luminaire illustrated in FIGS. 1–4, with a high-output T5 lamp, can achieve an acceptable level of uniformity in the brightness on the overhead ceiling (as measured by contract brightness ratios) by a luminaire spacing of 15 feet whereas with a T8 lamp the same uniformity would require the luminaires to be spaced much closer together, at an approximately 10 foot spacing.

Figure 5:
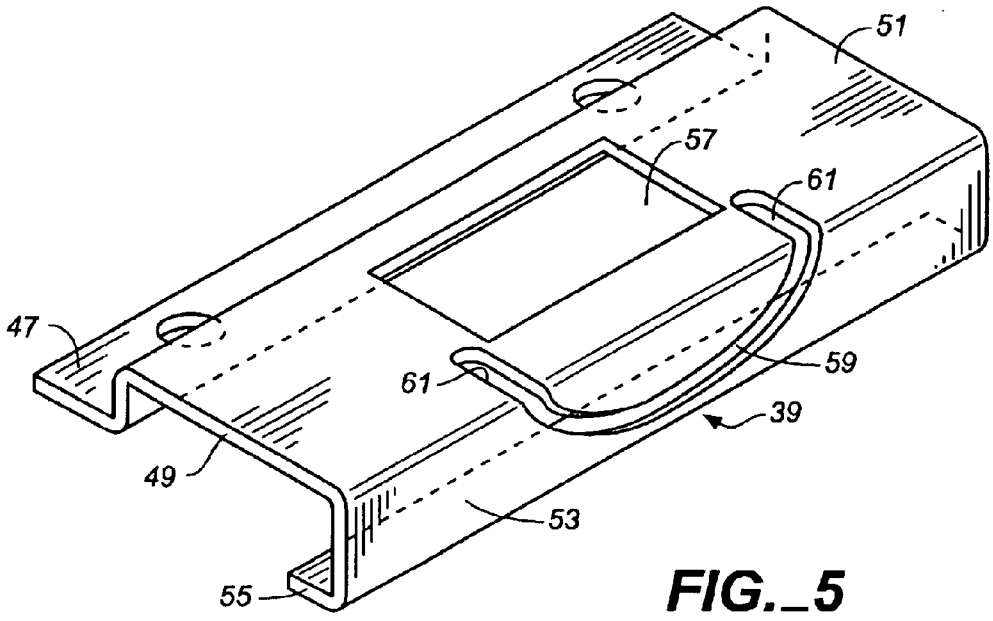
FIG. 5 is an enlarged top perspective view of the retainer bracket of the luminaire shown in FIG. 1, which replaceably holds one end of the luminaire's brightness reduction cover element.

FIG. 5 illustrates in greater detail the retainer bracket 39 for replaceably holding the diffuser cover strip 37 in its operative position in the luminaire housing 13. The retainer bracket is suitably a stamped and bent metal part having a flat rear edge portion 47 and a front channel-shaped portion 49 comprising a relatively wide top wall 51, a front wall 53 that extends somewhat below the rear edge portion 47, and an inwardly-extending leg 55. A rectangular opening 57 is punched in the top wall 51 for receiving the base of the sockets 19 and for permitting the sockets to be snapped onto the retainer bracket by spring clips 20 on the sides of each socket. The retaining bracket further includes a diffuser strip retention slot 59 in the bracket's front channel-shaped portion 49. The retention slot is formed by parallel straight sections 61 in the front edge of top wall 51 and a curved portion in front wall 53 having a radius that matches the radius of the arcuate diffuser strip. The retention slot is sized to slidably receive and capture one end of the luminaire's acuate diffuser strip 37, with the width of the slot being sufficiently large to allow for thermal expansion of the diffuser strip. If thermal expansion is not accounted for in the slot design, the diffuser strip will tend to bow due to the heat generated by the lamp 17 when it is on.

The diffuser cover strip 37 is easily and replaceably installed in the retaining brackets by first sliding one end of the diffuser strip in the retention slot of one of the retaining brackets 39*a*, 39*b* at one end of the luminaire and then sliding the opposite end of the diffuser strip in the retaining bracket at the luminaire's other end. The top wall straight sections 61 of the slot can be made sufficiently long to allow longitudinal movement or play of the diffuser strip within the retaining brackets. This will permit the first end of the strip to be moved in far enough into the first bracket to permit the opposite end to be maneuvered into the second bracket. Alternatively, the diffuser strip could be bent slightly to insert to ends or the brackets placed on the ends of the diffuser strip before the brackets are fastened to the socket straps. The diffuser strip can be similarly removed for cleaning or replacement due to damage or because it is desired to change to a diffuser cover strip of another color or transmission characteristic.

Figure 6:
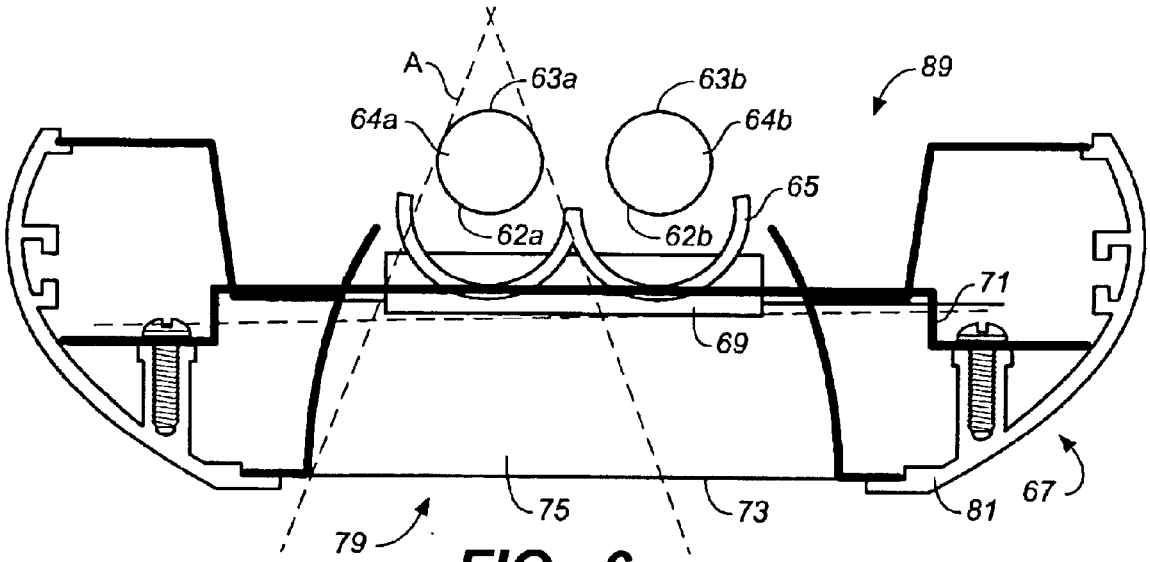
FIG. 6 is a side elevational view in cross-section of an alternative two lamp embodiment of the luminaire shown in FIG. 1.

FIG. 6 illustrates a two-lamp version of the luminaire shown in FIGS. 1–4. In this embodiment, the brightness reduction cover element for side-by-side fluorescent lamps 63*a*, 63*b* is provided in the form of a double arcuate diffuser cover strip 65 operatively positioned below and in close proximity to the side-by-side lamps. The diffuser cover strip is replaceably held in place by retaining brackets affixed to socket straps at each end of the luminaire 67, such as the illustrated retainer bracket 69 affixed to socket strap 71. These retainer brackets, which also hold the lamp sockets (not shown), are similar to the brackets 39 of the single lamp version, however, instead of the single curved slot 59 of the single lamp bracket, the double lamp brackets will have a double-curved slot (not shown) to accommodate the double arcuate shape of the diffuser strip. In its operative position, it can be seen that the double arcuate diffuser strip 65, like its single lamp companion, will additionally be supported by the top edges of the transverse baffle element 73 of the luminaire's baffle structure 75. It is also seen that, in this operative position, the outer upwardly extending ends 77*a*, 77*b* of the strip extend a short distance beyond the cutoff angle "A" to prevent line-of-sight exposure of either of the lamps 63*a*, 63*b* through the downlight opening 79 of the luminaire's housing 81.

Figure 6A:
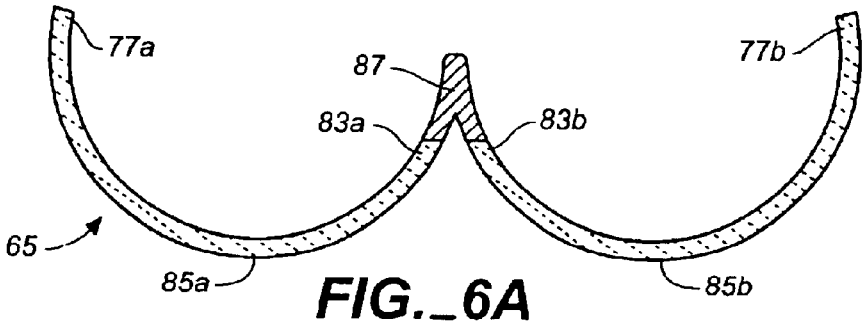
FIG. 6A is a cross-sectional view in side elevation of the diffuser cover element used with the two-lamp version of the luminaire shown in FIG. 6.

FIG. 6A shows how the upwardly extending interior edges 83*a*, 83*b* of the diffuser strip's separate arcuate portions 85*a*, 85*b* meet to form a center ridge 87 which, when the strip is installed as shown in FIG. 6, projects into the region between the luminaire's two side-by-side lamps 63*a*, 63*b*. Because of its closer proximity to the lamps and the fact that it receives light from both lamps, this center ridge will tend to exhibit a higher brightness than the rest of the diffuser strip and may be excessively bright. To prevent this, the center ridge is made to be opaque or substantially opaque as indicated by the crosshatched area in FIG. 6A. An opal diffuser strip having an opaque or substantially opaque center ridge can be fabricated using co-extrusion techniques well known in the industry. It is noted that the co-extruded opaque center ridge 87 has the additional benefit of providing a sense of visual separation between the two halves of the diffuser strip, thereby giving the illusion of two side-by-side lamps in the luminaire's down light opening 79.

To simulate two side-by-side 1 inch diameter T8 fluorescent lamps in a luminaire using as its active light source two side-by-side T5 high output lamps ⅛ inches apart on a center, an opal diffuser cover strip as shown in FIG. 6A can suitably have the following specifications:

| | |
|---|---|
| Distance from bottom of diffuser cover strip to a lamp center | ⅞ inch |
| Overall height of diffuser cover strip | ¾ inch |
| Radius R of each arcuate portion 85a, 85b | 19/32 inch |
| Thickness of a diffuser strip | 1/16 inch |
| Diffuser material | translucent white acrylic consisting of 4–5 lbs. of #1401 white added to 100 lbs, V825 HID, UL-94 HB compliance |
| Length of a co-extruded center ridge | ¼ inch |
| center ridge material | opaque white acrylic V825 HID W/100% 1502 white, UL94 HB compliance |

It is noted that the two lamp cover strip is somewhat more opaque than single lamp version. This is because the increase in surface area of the cover strip will increase the sensation of glare which can be compensated for by increasing the cover strips opacity.

The double arcuate diffuser cover strip 65 of the two-lamp version of the invention shown in FIG. 6 can replaceably be installed in the luminaire's retaining brackets 69 in a manner similar to that described in connection with the installation of the diffuser cover strip 37 in the single-lamp version of the luminaire. Once installed, the double arcuate diffuser cover strip will intercept light emitted from the bottom surface portion of the lamps, with the arcuate portion 85*a* of the diffuser strip intercepting light emitted mostly from the bottom surface portion 62*a* of lamp 63*a* while the second arcuate portion 85*b* intercept's light emitted mostly from the bottom surface portion 62*b* of lamp 63*b*. The observer who views the fixture through downlight opening 79 will therefore not see the lamps directly, but rather the double arcuate shape of the diffuser strip which will give the appearance of two side-by-side larger diameter fluorescent tubes having a lower surface brightness. On the other hand, the uplight component of the luminaire delivered through the top opening 89 of the luminaire's housing will be produced directly by the high lumen output of the top surface portions 64*a*, 64*b* of the side-by-side lamps.

Figure 8:
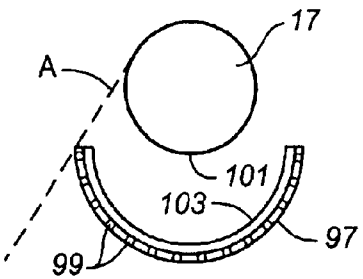
FIG. 8 is a pictorial view of a further embodiment of the brightness reduction cover element of the invention in the form of a sheet of perforated metal.
Figure 7:
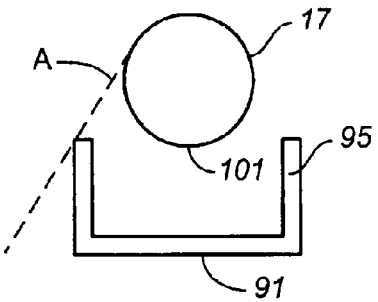
FIG. 7 is a pictorial view of another embodiment of the brightness reduction cover element of the invention in the form of a trough-shaped diffuser cover strip shown positioned below and in proximity to a light source.
Figure 4:
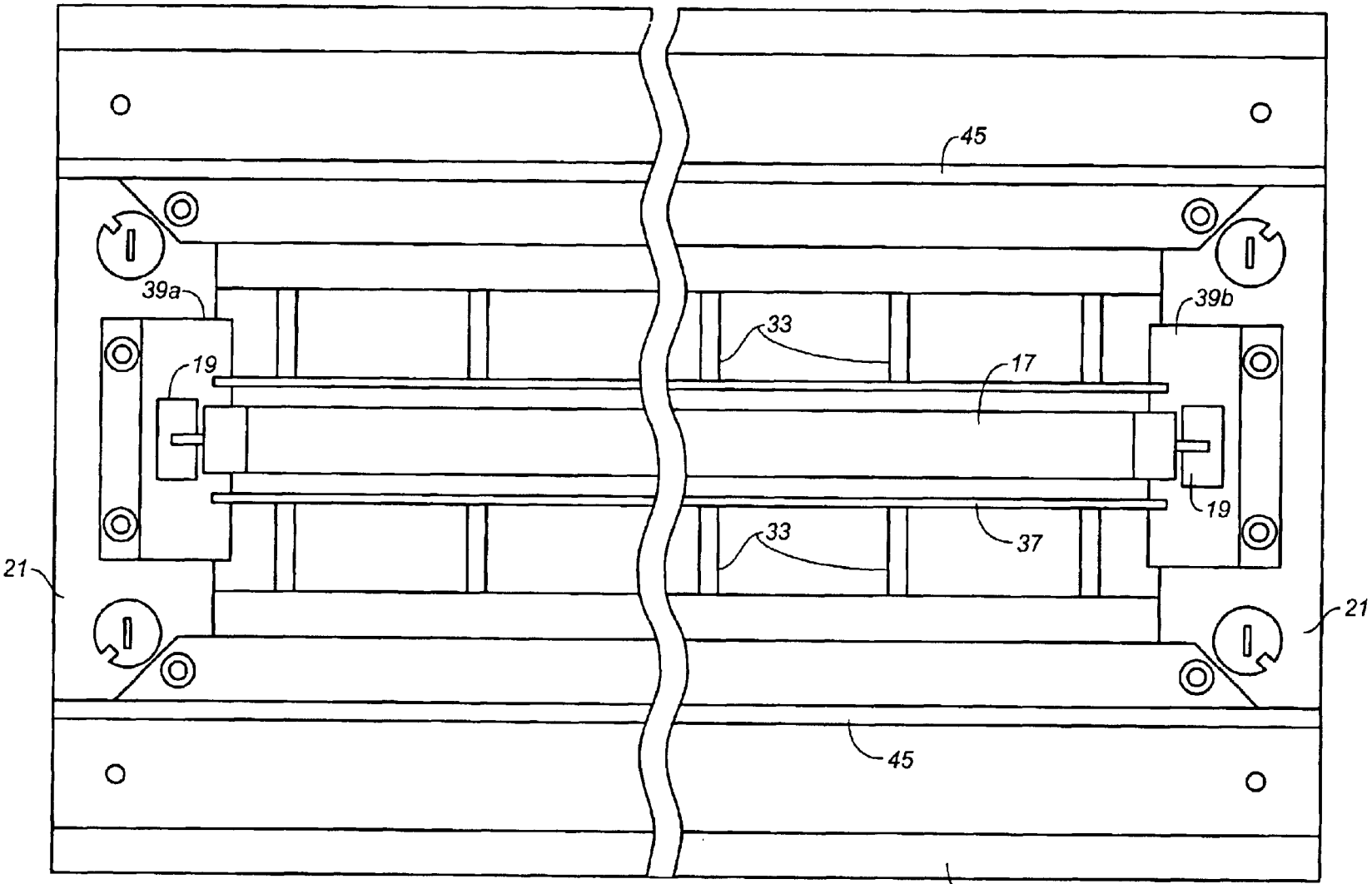
FIG. 4 is a top plan view thereof

FIGS. 7 and 8 show still further possible embodiments of the brightness reduction cover element of the invention. In FIG. 7, a trough-shaped rather than arcuate diffuser cover strip 91 is positioned below the luminaire's lamp 17 such that the vertical side walls 95 of the cover strip extend upwardly to a position that intercepts light emitted from the bottom surface portion 101 of the lamp up to a suitable cutoff "A" which prevents exposure of the lamp through the luminaire's downlight opening. In this embodiment, the luminous square diffuser strip will simulate a square lamp in the down light opening.

FIG. 8 shows an embodiment wherein the brightness reduction cover element is provided in the form of arcuate metal strip 97 having perforations 99 through which the light emitted from the bottom surface portion 101 of lamp passes. The metal strip can suitably have 1/16 inch diameter perforations with 1/8 inch center-to-center separations. In this version, the mock lamp will have the appearance of a tube having illuminated perforations throughout its length and will have an average of brightness which is substantially reduced from the brightness of the active fluorescent lamp 17. To reduce high spot brightness at the perforation openings, a diffuser lining 103 can be affixed to the back of the metal strip 97.

Therefore, the present invention generally provides for a luminaire having a mock light source for controlling source brightness through the downlight opening of the luminaire while retaining the benefits of the high lumen output from surfaces of the luminaire's light source that are not exposed. It will be appreciated that the invention is not limited to the embodiments described in detail herein, but can be implemented through a number of embodiments that would be the equivalent to those described. For example, brightness reduction cover elements as described herein can be used in luminaires having no shielding in its bottom opening or with different types of shielding structures than illustrated. Moreover, mock lamps can be created for active lamps of other types and shapes than the conventional straight fluorescent tubes illustrated, such as circular fluorescent lamps and biax lamps. The lamps also need not be high output lamps, for example, passive mock lamps could be created for a regular T5 lamp where surface brightness reduction is still desired. The surface brightness of a regular T5 lamp is substantially lower than that of a high output T5, but still higher than the surface brightness of a T8.

While the present invention has been described in considerable detail in the foregoing specification and claims, it shall be understood that it is not intended that the invention be limited to such detail, except as necessitated by the following claims.

What we claim is:

1. A luminaire having a mock light source for improved source brightness control comprising a housing having a downlight opening, at least one active light source operatively held in said housing above said downlight opening, said light source having a bottom surface portion which faces the downlight opening of said housing and which ordinarily would be exposed therethrough, and at least one brightness reduction cover element operatively positioned in said housing below and in proximity to the bottom surface portion of said at least one active light source, said brightness reduction cover element being sized and shaped to surround the bottom surface portion of said light source to substantially the minimum extent necessary to prevent exposure of the active light source through the downlight opening of said housing, said brightness reduction cover element being exposed through said downlight opening for providing an observable mock light source at the approximate position of said active light source wherein said mock light source has a reduced brightness surface to simulate a relatively low brightness light source within said housing.

2. The luminaire of claim 1 wherein the brightness reduction cover element is fabricated of light diffusing material.

3. The luminaire of claim 1 wherein said brightness reduction cover element has an arcuate shape to simulate a tubular-shaped light source when observed through said downlight opening.

4. The luminaire of claim 1 wherein said brightness reduction cover element has square shape to simulate a square-shaped light source when observed through said downlight opening.

5. The luminaire of claim 1 wherein said at least one light source includes two side-by-side fluorescent Tubes each of which has a bottom surface portion that faces the downlight opening in said housing, and wherein said brightness reduction cover element has two side-by-side arcuate portions, each of which is positioned below one of said side-by-side fluorescent tubes for intercepting light emitted therefrom.

6. The luminaire of claim 5 wherein the arcuate portions of said brightness reduction cover element have upwardly extending interior edges and wherein said arcuate portions are joined together at said upwardly extending interior edges to form a unitary structure.

7. The luminaire of claim 6 wherein the joined upwardly extending interior edges of the arcuate portions of said brightness reduction cover element are substantially opaque to achieve visual separation of the arcuate portions at the joined edges.

8. The luminaire of claim 1 wherein said light source includes at least one high output T5 fluorescent lamp and said brightness reduction cover element is sized, shaped and has brightness characteristics that simulate a standard T12 fluorescent lamp when observed through said downlight opening.

9. The luminaire of claim 1 wherein said light source includes at least one high output T5 fluorescent lamp and said brightness reduction cover element is sized, shaped and has brightness characteristics that simulate a standard T8 fluorescent lamp when observed through said downlight opening.

10. The luminaire of claim 1 wherein said housing has a top opening for indirect lighting and wherein said active light source has an uncovered top surface facing said top opening, said top surface providing an unobserved relatively high brightness source of indirect lighting while the brightness reduction cover clement provides an observed mock source of direct lighting having relatively low brightness.

11. The luminaire of claim 10 wherein said brightness reduction cover element is a light diffuser cover element.

12. The luminaire of claim 1 wherein said brightness reduction cover element is comprised of a perforated metal sheet material to produce an average brightness that 1s lower tho the brightness of said active light source.

13. The luminaire of claim 12 wherein said perforated metal sheet material has a thin diffuser liner to reduce high spot brightness on said sheet, material.

14. A luminaire having a mock linear light source for improved source brightness control comprising at least one elongated housing having an elongated downlight opening, an active tubular light source operatively held in said housing above said downlight opening, said light source having a bottom surface portion which aces the downlight opening of said housing and which is ordinarily exposed therethrough, and at least one elongated light diffuser cover strip operatively positioned in said housing below and in proximity to the bottom surface portion of said active tubular light source, said light diffuser cover strip extending upwardly about the bottom surface portion of said light source at least to, but not substantially beyond a defined cutoff angle which prevents exposure of said light source through the downlight opening of said housing, said diffuser cover strip being exposed through said downlight opening for providing an observable source of reduced brightness at the approximate position of said active tubular light source to simulate a relatively low brightness light source within said housing.

15. The luminaire of claim 14 wherein said tubular light source includes at least one fluorescent lamp of a defined diameter and said light diffuser cover strip is sized, shaped and has the reduced brightness characteristics of a fluorescent lamp of a larger diameter than said fluorescent lamp.

16. The luminaire of claim 15 wherein said light source includes at least one high output T5 fluorescent lamp and said light diffuser cover strip is sized, shaped, and has the reduced brightness characteristics to simulate a standard T12 fluorescent lamp.

17. The luminaire of claim 15 wherein said light source includes at least one high output T5 fluorescent lamp and said light differ cover strip is sized, shaped, and has the reduced brightness characteristics to simulate a standard T8 fluorescent lamp.

18. The luminaire of claim 14 wherein said light diffuser cover strip is fabricated of an opal diffuser material.

19. The luminaire of claim 14 wherein said light diffuser cover strip is removably secured in said housing.

20. The luminaire of claim 14 wherein said light diffuser cover strip extends upwardly about the active tubular light source a distance that is no greater than approximately one half the diameter of the light source.

21. An indirect-direct luminaire having an observable mock light source for improved source brightness control comprising a housing having a bottom downlight opening and top uplight opening, at least one light source operatively held in said housing above said downlight opening, said light source having a bottom surface portion which faces the downlight opening of said housing and which is exposed therethrough, and a top surface portion facing said top opening for providing indirect lighting therethrough, and at least one brightness reduction cover element operatively positioned in said housing below and in proximity to the bottom surface portion of said light source, said brightness reduction cover element extending upwardly about the bottom surface portion of said light source a sufficient distance to prevent exposure of said light source through the downlight opening of said housing without substantially affecting the indirect lighting produced through the top opening of said housing, said brightness reduction cover element being exposed through said downlight opening for providing an observable source of reduced brightness at the approximate position of said light source to simulate a relatively low brightness light source within said housing.

22. The direct-indirect luminaire of claim 21 wherein said brightness reduction cover element is replaceably held in said housing.

23. The direct-indirect luminaire of claim 21 further comprising a baffle structure in the downlight opening of said housing below said the brightness reduction cover element for shielding said brightness reduction cover element from direct view at high viewing angles.

24. The direct-indirect luminaire of claim 23 wherein said baffle structure includes transverse baffle elements have top edges and wherein said brightness reduction cover element is supported along the top edges of said baffle elements.

25. A luminaire having an active high output fluorescent lamp with high surface brightness comprising an elongated housing for said high output lamp, said housing having an elongated downlight opening, and a light diffuser cover strip operatively positioned in said housing below and in proximity to a bottom surface portion of said high output fluorescent lamp and being observable through the downlight opening of said housing, said light diffuser cover strip extending upwardly about the bottom surface portion of said active high output fluorescent lamp in a substantially semi-cylindrical shape and simulating the tubular shape of a fluorescent lamp which is larger than and has a reduced surface brightness as compared to the active high output fluorescent lamp of said luminaire.

26. The luminaire of claim 25 wherein said light differ cover strip is sized, shaped and has brightness characteristics that simulate a standard T8 fluorescent lamp when observed through said downlight opening.

27. The luminaire of claim 26 wherein said active high output fluorescent lamp includes at least one high output T5 fluorescent lamp.

28. The luminaire of claim 25 wherein said light diffuser cover strip is sized, shaped and has brightness characteristics that simulate a standard T12 fluorescent lamp when observed through said downlight opening.

29. The luminaire of claim 28 wherein said active high output fluorescent lamp includes at least one high output T5 fluorescent lamp.

30. A luminaire having a mock linear light source for improved source brightness control comprising an elongated housing having an elongated downlight opening, an active light source operatively held in said housing, said light source having a bottom surface portion which is ordinarily exposed through the down light opening of said housing and further having a characteristic surface brightness, an elongated light diffuser cover strip having a uniform cross-sectional shape that simulates the size and shape of an elongated light source having a larger surface area the said active light source, said elongated cover strip having lengthwise ends of a defined cross-sectional shape, and cover strip retainer brackets in said housing for replaceably holding the ends of said diffuser cover strip and for positioning said cover strip below and in proximity to the bottom surface portion of said active light source such that said cover strip extends upwardly about the bottom surface portion of said light source, said cover strip being exposed through said downlight opening for providing an observable source of reduced brightness at the approximate position of said active light source to simulate an elongated light source within said housing having relatively low surface brightness as compared to the surface brightness of said active light source.

31. The luminaire of claim 30 wherein each of said cover strip retainer brackets includes a cover strip retention slot having a shape conforming to the cross-sectional shape of the ends of the cover strip for slidably receiving the ends of the cover strip.

32. The luminaire of claim 31 wherein the cover strip retention slot in at least one of said retainer brackets has sufficient width to allow for thermal expansion of said cover strip.

33. The luminaire of claim 31 wherein said cover strip has a semi-cylindrical shape to simulate a tubular shaped light source, and the retention slot in each said retainer brackets is semi-circular shape conforming to the shape of said cover strip.

34. A method of producing direct and indirect lighting from at least one active light source having top and bottom surface portions with relatively high surface brightness comprising producing uplight for indirect lighting directly from the top surface portion of said at least one light source, and producing downlight for direct lighting through at last one brightness reduction cover clement positioned below and in close proximity to the bottom surface portion of said light source, said brightness reduction cover element being sized and shaped to surround the bottom surface portion of said light source so as to simulate a relatively low brightness light source having a larger surface area than the surface area of said light source, and said brightness reduction cover element further being positioned so that indirect lighting produced by said uplight from the top surface portion of the light source is not affected by said brightness reduction cover element.

35. The method of claim 34 wherein said brightness reduction cover element has a substantially semi-cylindrical shape and, when viewed from the direction of the bottom surface portion of said light source, simulates a fluorescent lamp of a desired size having a surface brightness which is lower than the surface brightness of said active light source.

36. The method of claim 35 wherein said active light source is a high output T5 flourescent lamp having top and bottom surface portions with relatively high surface brightness and wherein said brightness reduction cover element, when viewed from the direction of the bottom surface portion of said high output T5 fluorescent lamp, simulates a fluorescent lamp having a diameter of between approximately 1 and 1½ inches.

37. The method of claim 35 wherein said active light source is a regular T5 flourescent lamp having top and bottom surface portions with relatively high surface brightness and wherein said brightness reduction cover element, when viewed from the direction of the bottom surface portion of said regular T5 fluorescent lamp, simulates a fluorescent lamp having a diameter of between approximately 1 and 1½ inches.

38. The method of claim 34 wherein said active light source includes at least two side-by-side active fluorescent lamps, wherein a brightness reduction cover element is provided for each of said side-by-side active fluorescent lamps, and wherein each of said brightness reduction cover element have a substantially semi-cylindrical shape to simulate two side-by-side light sources in the form of side-by-side fluorescent lamps of a desired size which have a surface brightness that is lower than the surface brightness of said active fluorescent lamps.

39. The method of claim 38 wherein the cover elements for said fluorescent lamps are joined along their interior edges to form a unitary cover element structure which simulate two side-by-side fluorescent lamps.

40. The method of claim 39 wherein the joined interior edges of the arcuate portions of said brightness reduction cover element are substantially opaque to achieve visual separation of the arcuate portions at the joined edges.

41. The method of claim 39 wherein said at least two side-by-side active fluorescent lamps are high output T5 lamps and the brightness reduction cover element for each said active high output T5 fluorescent lamp simulates a T8 fluorescent lamp when observed from a position blow the active light source.

42. The method of claim 39 wherein said at least two side-by-side active fluorescent lamps are regular T5 lamps and the brightness reduction cover element for each said active high output T5 fluorescent lamp simulates a T8 fluorescent lamp when observed from a position below the active light source.

43. The method of claim 39 wherein said at least two side-by-side active fluorescent lamps are high output T5 lamps and the brightness reduction cover element for each said active high output T5 fluorescent lamp simulates a T12 fluorescent lamp when observed from a position below the active light source.

44. The method of claim 39 wherein said at least two side-by-side active fluorescent lamps are regular T5 lamps and the brightness reduction cover element for each said active T5 fluorescent lamp simulates a T12 fluorescent lamp when observed from a position below the active light source.

* * * * *

UNITED STATES PATENT AND TRADEMARK OFFICE

CERTIFICATE OF CORRECTION

PATENT NO. : 6,709,131 B1
DATED : March 23, 2004
INVENTOR(S) : Herst et al.

It is certified that error appears in the above-identified patent and that said Letters Patent is hereby corrected as shown below:

Column 4,
Line 27, “It” should read -- it --.
Line 44, please add -- . -- at the end of the line.

Column 5,
Line 35, please delete the “-” between the words “seen” and “by”.

Column 10,
Line 8, “Tubes” should read -- tubes --.
Line 47, “Is” should read -- is --.
Line 48, “tho” should read -- than --.
Line 58, “aces” should read -- faces --.

Column 11,
Line 19, “differ” should read -- diffuser --.

Column 12,
Line 16, “differ” should read -- diffuser --.
Line 42, please change “the said” to read -- than said --.

Column 13,
Line 10, “last” should read -- least --.

Column 14,
Line 24, “blow” should read -- below --.

Signed and Sealed this

Twenty-seventh Day of September, 2005

JON W. DUDAS
*Director of the United States Patent and Trademark Office*